United States Patent [19]

Fischer et al.

[11] 4,414,466

[45] Nov. 8, 1983

[54] ELECTRIC HOTPLATE

[75] Inventors: Karl Fischer, Am Gänsberg, D-7519 Oberderdingen; Felix Schreder, Oberderdingen, both of Fed. Rep. of Germany

[73] Assignee: Karl Fischer, Fed. Rep. of Germany

[21] Appl. No.: 411,426

[22] Filed: Aug. 25, 1982

Related U.S. Application Data

[63] Continuation of Ser. No. 177,873, Aug. 14, 1980, Pat. No. 4,348,581.

[30] Foreign Application Priority Data

Aug. 17, 1979 [DE] Fed. Rep. of Germany ..... 2933296

[51] Int. Cl.[3] ..... H05B 3/68

[52] U.S. Cl. ..... 219/459; 219/458; 219/463; 219/536

[58] Field of Search ..... 219/447, 433, 449, 451, 219/455-467, 536, 537; 362/281

[56] References Cited

U.S. PATENT DOCUMENTS

| | | | |
|---|---|---|---|
| 1,644,255 | 10/1927 | Kercher et al. | 219/464 |
| 1,659,986 | 2/1928 | Baughman et al. | 219/459 |
| 2,260,165 | 10/1941 | Calhoun | 219/461 |
| 2,301,085 | 11/1942 | Smith | 219/458 X |
| 2,422,057 | 6/1947 | Weinhardt | 219/459 |
| 2,666,979 | 1/1954 | Van Dusen | 219/433 X |
| 2,691,719 | 10/1954 | Marco | 362/281 |
| 3,300,621 | 1/1967 | Fischer | 219/457 |
| 3,838,249 | 9/1974 | Detterbeck | 219/460 |
| 4,122,330 | 10/1978 | Fischer et al. | 219/449 |
| 4,153,833 | 5/1979 | Fischer et al. | 219/449 |

FOREIGN PATENT DOCUMENTS

| | | | |
|---|---|---|---|
| 99599 | 4/1960 | Denmark | 219/458 |
| 76480 | 5/1918 | Fed. Rep. of Germany | 219/459 |
| 153865 | 7/1938 | Fed. Rep. of Germany | 219/459 |
| 68454 | 6/1914 | Switzerland | 219/459 |
| 365848 | 1/1963 | Switzerland | 219/451 |

*Primary Examiner*—Volodymyr Y. Mayewsky
*Attorney, Agent, or Firm*—Steele, Gould & Fried

[57] ABSTRACT

An electric hotplate with a cast member has a downwardly-directed border on its outer periphery. The edge of a covering sheet centrally fixed to the hotplate by a hollow screw rests on the lower edge of the border. A covering sheet step is centered within the border. A moisture-proof closure is obtained through an interposed seal and insulation is provided by a crinkled aluminum foil. The hot plate connecting leads are passed via an insulating member through the covering sheet which, peripherally displaced by 180°, faces a depression in the covering sheet so that hot plates according to the invention can be stacked in a space-saving manner. The connecting leads are flexible and their ends are brought together in a common connecting member.

9 Claims, 15 Drawing Figures

ELECTRIC HOTPLATE

CROSS-REFERENCE

This application is a continuation of copending application Ser. No. 177,873 filed Aug. 14, 1980, now U.S. Pat. No. 4,348,581.

BACKGROUND OF THE INVENTION (1) Field of the Invention

The invention relates to an electric hotplate for the use in cooking appliances, cookers, hobs or the like and more particularly to the fastening of a covering sheet for the underside of the hotplate and to the mounting of the hotplate to a cooking applicance.

(2) Description of the Prior Art

In applicants' U.S. Pat. Nos. 4,122,330 and 4,153,833 it is shown to screw a threaded bolt into a central pin of the hotplate member and to fix the covering sheet in position by means of a nut screwed thereon. Therefore, two threading operations are required. Moreover, the threaded bolt protrudes some way out of the hotplate, with the result that the packed dimensions are twice as large as the entire height of the hotplate and, furthermore, for transporting, adjacent hotplates have to be axially offset so as not to increase the packing dimensions still further. The protruding part of the threaded bolt is intended to attach the hotplate to a bracket by means of another nut screwed on, by which the hotplate is clamped downwardly.

U.S. Pat. No. 2,691,719 shows additionally a tubular washer between the two nuts engaging the covering sheet and the bracket.

OBJECT AND SUMMARY OF THE INVENTION

It is an object of the invention to provide an improved means for fastening the covering sheet to the hotplate and for mounting the hotplate to the cooking appliance. A further object is to provide a fastening means which helps to minimize the packed dimensions of the hotplate.

According to the invention, the screw is a hollow screw with an external and internal thread, a head or shoulder of which secures the covering sheet, and into which it is possible to screw a fastening screw for the electric hotplate. It is therefore only necessary to screw in the hollow screw to secure the covering sheet when assembling the hotplate. Later, when the hotplate is fitted, a conventional cap screw is used to secure the hotplate to the cooking applicance or the like. The hollow screw can be secured more satisfactorily and the packing and transporting work is reduced. In addition, there is greater adaptability to different heights of installation, as it is merely necessary to use different conventional cap screws as fastening screws.

BRIEF DESCRIPTION OF THE DRAWINGS

The invention is described in greater detail hereinafter relative to preferred, but non-limitative embodiments of the invention and with reference to the attached drawings, wherein show.

DETAILED DESCRIPTION OF THE PREFERRED EMBODIMENTS

Figure 1:
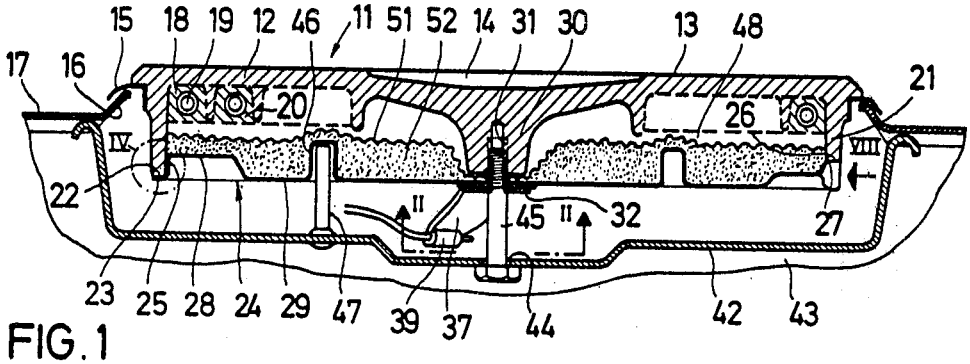
FIG. 1 is a cross section through an electric hotplate installed in an electric cooker, hob or the like, FIG. 2 a detailed view, in section on the line II—II in FIG. 1, FIG. 3 a section through an alternative embodiment of a detail from FIG. 1.

FIG. 1 shows an electric hotplate 11 comprising a hotplate member 12 consisting of cast iron with a flat, sealed, upper cooking surface 13. The unheated central zone 14 is recessed so as to form an annular cooking surface. At its outer periphery, the hotplate member engages over an overflow rim 15 consisting of sheet material of substantially U-shaped cross section, which rests on the raised rim 16 of the opening in the work plate 17 of a cooking appliance, e.g. an electric cooker or hob.

In the heated annular zone, the hotplate is provided with ribs extending in a spiral configuration which form between them spiral grooves 18 in which there are provided heating coils 19 embedded in a ceramics mass 20.

A downwardly directed, substantially cylindrical border 21 projects in the circumferential region of the hotplate member, while a flange-like border region of a cylindrical covering sheet 24 which is deformed and reinforced by embossed portions rests on the lower edge 22 of said border 21. The covering sheet has a border region 23 adjoned by a step 25 which is directed upwardly, i.e. towards the cooking surface, and which abuts on the inside of the border 21 and thus centers the covering sheet or cover.

Figure 8:
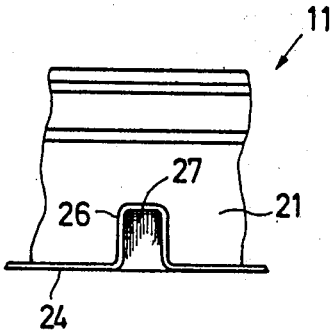
FIG. 8 shows a detail, viewed in the direction of the arrow VIII in FIG. 1.

At one point on its circumference, the border 21 has a recess 26 in the form of a rectangular cutout (FIG. 8) into which a corresponding embossed portion 27 of the covering sheet fits and thus prevents rotation of the covering sheet 24 on the hotplate member in spite of the relatively tight seal provided. For its part, the embossed portion 27 of the covering sheet ensures that the finished hotplate can be aligned in the circumferential direction when being handled during production. As a result, no inner projection on the border 21 is required.

Adjoining the step 25 is a region 28 of the covering sheet which is recessed relative to the border region 23 and adjoining said region 28 is a central region 29 which projects to some extent relative to the border region 23.

Figure 2:
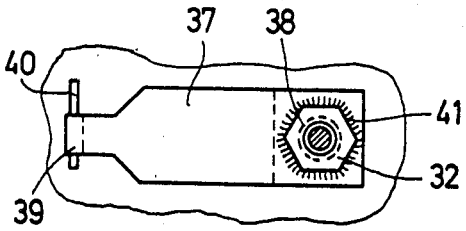
Figure 9:
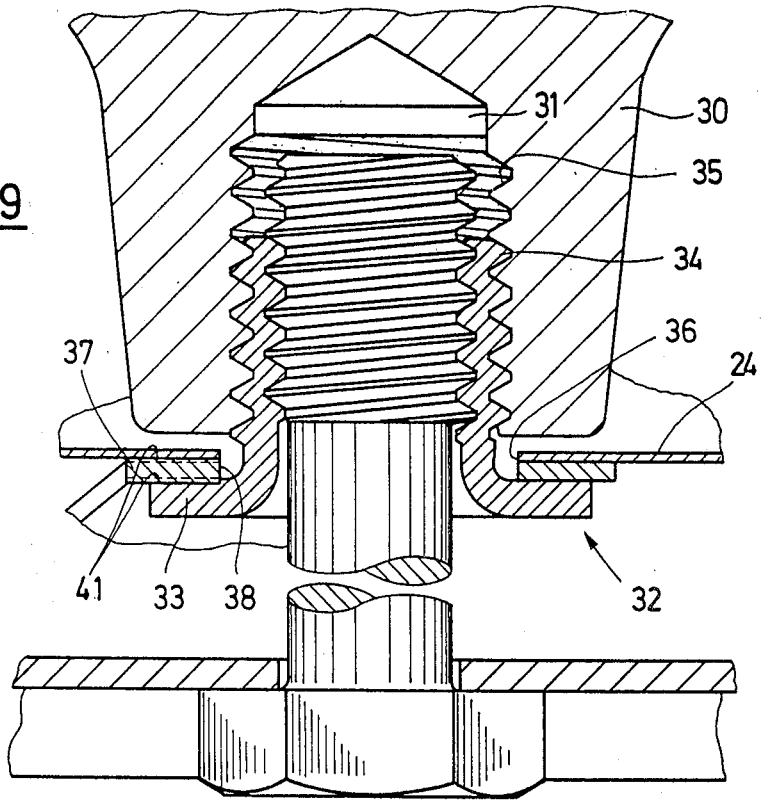
FIG. 9 shows an enlarged view of the detail showing the central fixing of the hotplate according to FIG. 1.

In the center of the unheated central zone 14, the hotplate member has a downwardly projecting pin 30 into which a threaded blind bore 31 projects from below. A hollow cap screw 32, shown in detail in FIG. 9, is screwed into this threaded bore. This screw 32 consists of a stamped or deep-drawn sheet metal part with a flange-like cap region 33 with a hexagonal spanner surface or key faces and a sleeve-shaped threaded portion 34 adjoining the latter, into which an internal and external thread is pressed or forced. The screw 32 projects through a central hole 36 in the covering sheet 24 and is screwed into the thread 35 of the bore 31 so that the covering sheet 24 is pressed with its border region 23 against the lower edge 22 of the border 21 of the hotplate member 12. Interposed between the cap region 33 and the covering sheet there is a sheet metal part 37 (FIG. 2) in the form of a sheet metal strip having, on one side, a hole 38 through which the screw 32 passes, while the other end tapers somewhat and a bent end 39 (FIGS. 1 and 2) surrounds an earth lead 40. The earth lead may be pressed or welded on to the sheet metal part 37. Thus, this sheet metal part is simply placed under the screw head 33 like a washer and and provedes a safe earth connection. It is particularly advantageous if the sheet metal part lies flat against the underside of the covering sheet 24 during production and shipping and is not bent away from the covering sheet until required. As a result, the earth connection does not substantially increase the height of the hotplate.

The left-hand side of FIG. 9 shows that the abutment surface or shoulder of the cap region 33 can be provided with a preferably starshaped groove 41. The sheet metal part 37 is correspondingly structured on its top and bottom, and so is the covering sheet 24 (cf. FIGS. 2 and 15), thus preventing the screw 32 from accidentally working loose. However, other securing methods may also be used.

The hotplate is held in the opening in the work plate which receives it by means of a bracket 42 which rests on the underside of the work plate 17 and has a flat U-shape. Its long back is reinforced by means of lateral bends 43. A cap screw 45 which is screwed into the internal thread in the hollow screw 32 projects through a hole 44 in the centre of the bracket. In this way, the hotplate is clamped down by the screw and bracket and is securely fixed in position. This method of attachment uses only cap screws, which can easily be tightened using automatic screw drivers. The screw 32 is a simple stamped sheet metal part and the screw 45 is a simple machine screw. Until now, hot plates have been fitted with screw bolts which were screwed into the pins 30 and projected far beyond the underside of the hotplate. Two or more nuts screwed on to these bolts secured the covering sheet and hotplate to the bracket. Consequently, it was not possible to pack the hotplates in a space-saving manner. Now, however, the hotplate when packed takes up only the room which its requires for itself and there is the additional advantage that the length of the screw 45 can be selected according to the height of the bracket. This is particularly important if the hotplate is to be fixed in very flat built-in hobs. Thus, one type of hotplate can be used for brackets of all heights. Previously, the various types of hotplates had to be fitted with screw bolts of different lengths for this purpose.

Riveted to the bracket 42 is an upwardly projecting rod 47 which engages in a sleeve-like recess 46 formed inwardly in one piece with the covering sheet, and thus prevents the hotplate from rotating relative to the bracket. In order to provide a number of possible methods of installation for the hotplate, which is particularly important because of the position of the connecting leads, a plurality of recesses 46 may be provided on the circumference, optionally also offset by 90° relative to one another. The fact that the anti-rotation rod 45 is mounted on the bracket instead of on the hotplate as before means that the overall dimensions of depth of the hotplate are kept small. The recess 46 is closed off so that the hot inner space 48 of the hotplate formed between the covering sheet 24 and the hotplate member 12 is sealed off.

Figure 3:
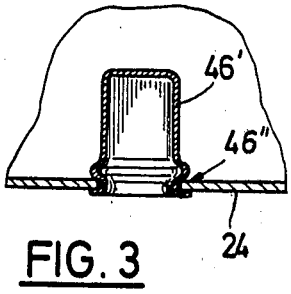

FIG. 3 shows an alternative embodiment for the recess 46 which may be used if the sheet metal from which the covering plate 24 is made should not be subjected to any great deformation. A separately produced sleeve 46' is tightly secured in an opening in the covering sheet 24 by means of a two-sided flange 46''. It is also possible to provide the sleeve, in the region of the flange 46'', for example, with a pressed-in thread for the subsequent screwing-in of a rod.

Figure 4:
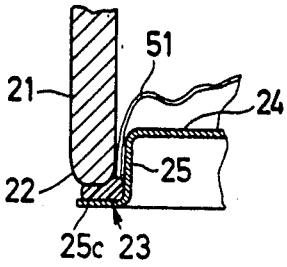
FIG. 4 shows the detail indicated by the dash-dot circle IV in FIG. 1, on a larger scale.
Figure 5:
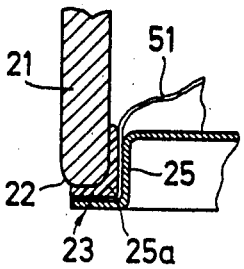
FIGS. 5 to 7 show alternative embodiments of the detail shown in FIG. 4.
Figure 6:
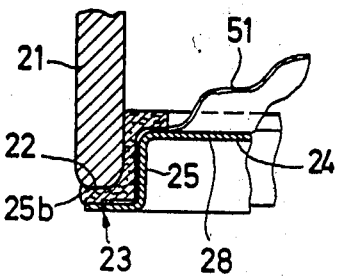

FIG. 4 shows a detailed view wherein a sealing ring **25*c*, which may be flat or circular in cross section and which is made of a heat-resistant sealing material, is inserted between the border region 23 of the covering sheet 24 and the lower edge 22 of the hotplate border 21. Suitable materials for the sealing ring 25*c* include silicon rubber, asbestos-containing sealing materials, etc. Other embodiments of seals are shown in FIGS. 5 and 6, the seal 25*a* in FIG. 5 consisting of a paste which is introduced into the angle between the border region 23 and the step 25 and spreads over the lower edge 22 and the inside of the border 21 when pressure is applied. This embodiment provides a particularly advantageous method of sealing in the region of the recess 26**.

FIG. 6 shows, at the corresponding point, a prefabricated sealing ring **25*b* of Z-shaped cross section which covers the lower edge 22, the inside of the border 21 and part of the inner surface of the recessed portion 28 of the covering sheet 24**. This sealing ring may consist of a moulding compound produced from an aluminasilicate fibre and impregnated with a lacquer based on silicon resin.

When a seal is used on the outer periphery it is also advisable to provide a seal in the region of the screw 32.

The seal is intended to prevent moisture from penetrating into the inner space 48 of the hotplate and thus possibly into the embedding mass 20 if the hotplate is exposed to extreme conditions, such as being transported by sea. Certainly, the hotplate will immediately repel any moisture which gets in, without producing any inadmissible leakage currents, but the seal provides an additional protection. The seal is established particularly by the abutment of the covering sheet on the lower flange, since this means that the seal is provided in a region of lower temperature and can be arranged better. Earlier covering sheets were placed on the underside of the embedding compound 20. The step 25 provides an additional seal and perfect centering.

Figure 7:
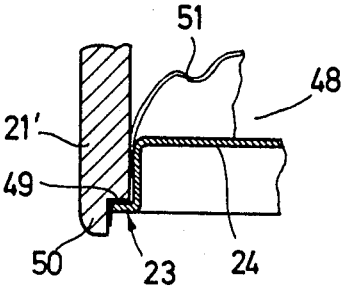

FIG. 7 shows an embodiment wherein the border 21' of the hotplate member comprises a step-shaped recess 49 on its inner underside so as to form an external continuous border portion 50 of the border 21' which extends somewhat further downwards than the abutment surface for the border region 23 of the covering sheet 24. This means that, if there is a risk of water running down under the hotplate, which can only happen in exceptional circumstances, the water will drip away without being sucked into the inner space 48 by capillary action.

FIG. 1 shows that a metal foil 51, more particularly a piece of bright crinkled aluminium foil, is located in the inner space parallel to the covering sheet. It is clamped between the border 21 and the covering sheet 24 or the seals provided (see FIGS. 4 to 7) and encloses, between itself and the covering sheet 24, a coating 52 which preferably consists of silica gel or kieselguhr or contains the latter. This material not only provides good insulation but also ensures that any moisture which has got in, e.g. as moisture from the air, is absorbed in the silica gel which acts as a drying agent. As a result of the automatic heating during operation of the hotplate, the drying agent is constantly regenerated automatically as the water is expelled and thus remains permanently effective. If a drying agent is used, it may be a good idea to perforate the metal foil or to place the drying agent in other contains in the inner space 48 to ensure that it is effective.

If there is no danger of any extreme conditions occuring as regards moisture levels, the coating 52 may be made from highly heat-resistant insulating materials such as inorganic fibres like asbestos or other known insulating materials. In conjunction with the metal foil located above, very effective insulation is obtained which further reduces any downward heat losses and caused by radiation and convection, which are in any case very slight in contact-type hotplates. However, in particular this ensures that the temperature of the covering sheet 24 is kept low, so that the hotplate can be installed even in the flattest hobs near wooden parts of kitchen furniture.

Figure 10:
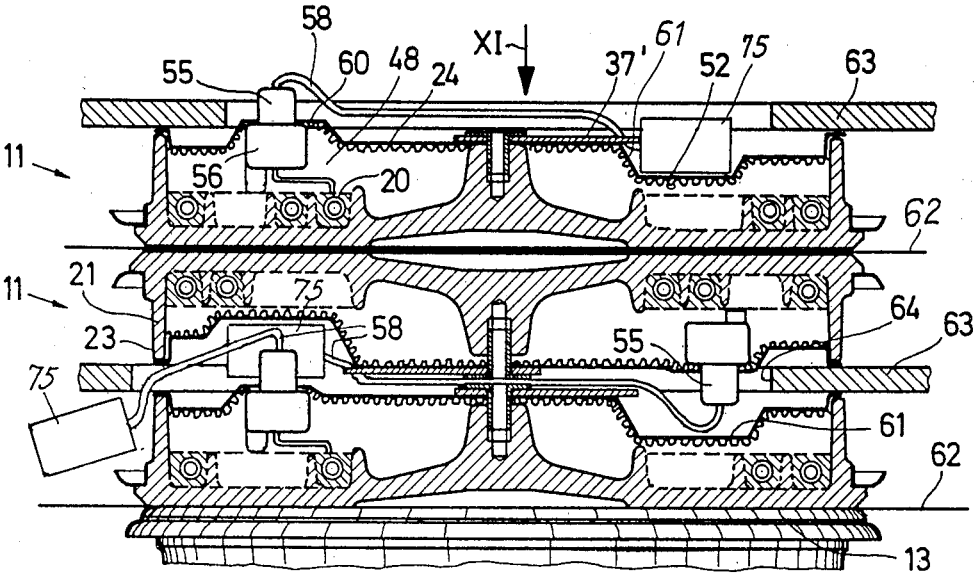
FIG. 10 shows three hotplates stacked one above the other, corresponding to the hotplate shown in FIG. 1, apart from the earth connection, and the associated packing means.
Figure 11:
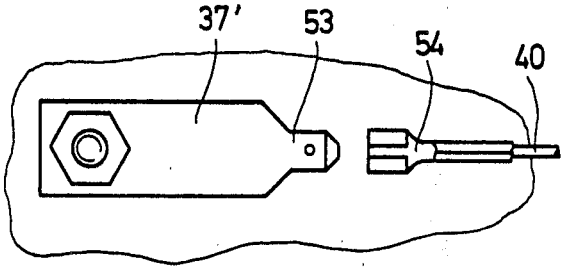
FIG. 11 shows a detailed plan view in the direction of the arrow XI in FIG. 10.

FIG. 10 shows three hotplates stacked one above the other; apart from the fact that the sheet metal part 37′ (cf. FIG. 11) is provided with a flat insertion tongue 53 for the connection of a corresponding flat plug 54 for the earth lead 40, these hotplates are identical to the one shown in FIG. 1. Throughout the description, the same reference numerals have bee used to denote identical parts. The direction of the section in FIG. 10 is offset by 45° relative to FIG. 1 so as to show that, projecting through the covering sheet 24, there is an insulating member 55 which rests inside the latter and contains a temperature limiting means 56 in its portion located in the inner space 48 and comprises continuous openings 57 (FIG. 15) arranged sideby side, through which connecting leads 58 having a highly heat-resistant insulation project out of the inner space 48 where they are welded to connecting pins projecting out of the embedding mass 20. The basic form of the insulating member is elongated in the circumferential direction and it projects through the covering sheet in the region of a bulge 60.

The connecting leads 58 are connected to a common connecting member 75 of ceramics insulating material (FIGS. 10 and 15) which contains plug-in or screw connection clips 76 for the connection of current feed lines 78. Owing to the arrangement of the insulating member in the radial direction substantially in the center of the annular heated zone and the dimensions of the connecting leads, the outer edge 77 of the connecting member 75 is preferably at most at a spacing from the outer edge thereof which is less than a radius of the hotplate and can flexibly be adapted to the particular conditions of installation, the connecting leads acting as a flexible strip which permits slight pivoting and greater mobility of the connecting member in the vertical direction but more strongly restricts rotation and lateral movement.

Diametrically opposite the insulating member 55 and at a corresponding radial distance from the center of the hotplate there is provided, in the covering sheet 24, a depression 61 the dimensions of which are such that it can safely receive the projecting portion of the insulating member in the mutual arrangement of the hotplate shown in FIG. 10, without the connecting leads 58 having to be bent too sharply. The width of the depression is substantially greater than that of the insulating member so that, as can be seen in FIG. 10 in the top two hotplates, the connecting leads 58 can be folded inwards and the connecting member 77 together with the insulating member can be placed in the depression 61. It is also possible to fold the connecting member 77 (bottom of FIG. 10) outwards and place it substantially in a plane with the hotplate, while the connecting leads 58 pass through a corresponding cutout in the packing plate 63.

Thanks to the depression in the covering sheet, it is possible to pack the hotplates in a particularly safe and space-saving manner for storage and dispatch. For this purpose, the hotplates are stacked one above the other with their central axes in alignment and with their flat cooking surfaces 13 and their undersides covered by the covering sheets 24 directed towards each other, while, between the cooking surfaces 13, only a sheet or film 62 is inserted, to prevent scratches, and between the undersides of the hotplates a packing plate 63 is placed, which may consist of plywood or press-board and which has recesses designed so that the hotplate is centered when it is placed thereon. Parts of the hotplate projecting downwards relative to the outer edge 23 of the covering plate project into the recess 64 in the packing plate 63.

The hotplates 11 are offset by 180° relative to one another in the circumferential direction, so that the insulating member 55 with the connecting leads projects into the depression 61 and the hotplate even takes up less packing space than its own overall height. The borders 21 rest on one another, via the interposed packing plate 63, to form a firm stack with no tendency to tilt over. The aligned arrangement of the hotplates one above the other also particularly contributes to this. Depending on the desired packaging or pallet size, the packing plates 63 have a plurality of recesses 64 arranged side by side and behind one another so that a large number of hotplates can be stored and transported in a solid block; this not only saves storage and transporting costs but also gives greater protection against damage. Packing can also be carried out fully automatically by means of gripping devices.

The hotplates according to FIG. 10 do not have the silica gel filling. For insulation purposes only, crinkled aluminium foil 51 is placed parallel to the covering sheet 24.

Figure 14:
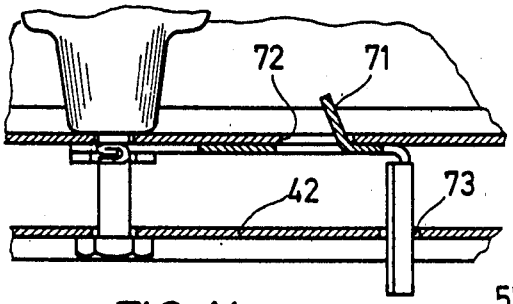
FIG. 14 shows a detailed section through the lower central region of a hotplate in the installed state.

FIGS. 12 to 15 show another apparatus for preventing the hotplate from rotating relative to the securing means, e.g. the bracket 42. For this purpose, a sheet metal part 65 is used in the form of a flat right-angled strip which extends through in the region of the bend 66. Lateral indentations 67 form separate border areas at the ends of the portions 68, which are bent over or rolled round at the ends (cf. FIG. 13 in particular), so that the ends are in the form of pins. U-shaped cutouts 70 are provided in the portions 68 so as to form sheet metal tabs which are bent out from the plane of the portions 68. FIG. 14 shows this sheet metal part 65 in the installed position. Like the sheet metal part 37 in FIG. 1 it is secured to the hotplate by the screw 32 and is prevented from rotating thereon by the tab 71 which projects through an opening 72 in the hotplate. Instead of the opening 72 a corresponding embossed portion could also be provided so as not to perforate the covering sheet. Preferably, the ends 69 are not bent out through about 90° until the hotplate is installed in a cooker or the like; this bending is easily effected thanks to the indentations 67. Only the end 69 which is to be inserted in a hole 73 in the fixing bracket 42' has to be bent out. This, too, provides a protection against rotation without increasing the transporting space.

Figure 12:
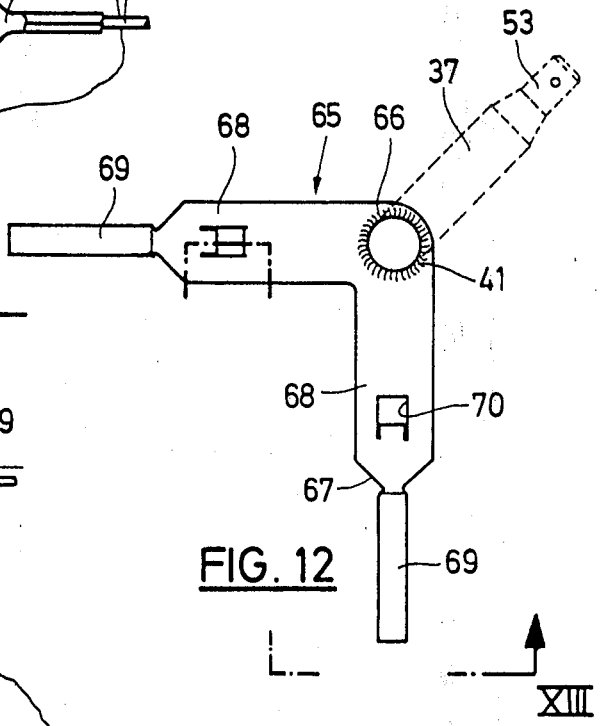
FIG. 12 shows a plan view of a sheet metal part used to prevent rotation and possibly act as an earth connection.
Figure 13:
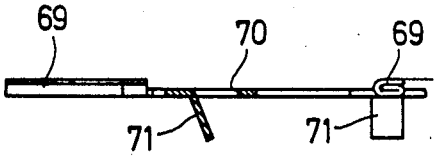
FIG. 13 shows a partially cut-away view on the line XIII—XIII in FIG. 12.
Figure 15:
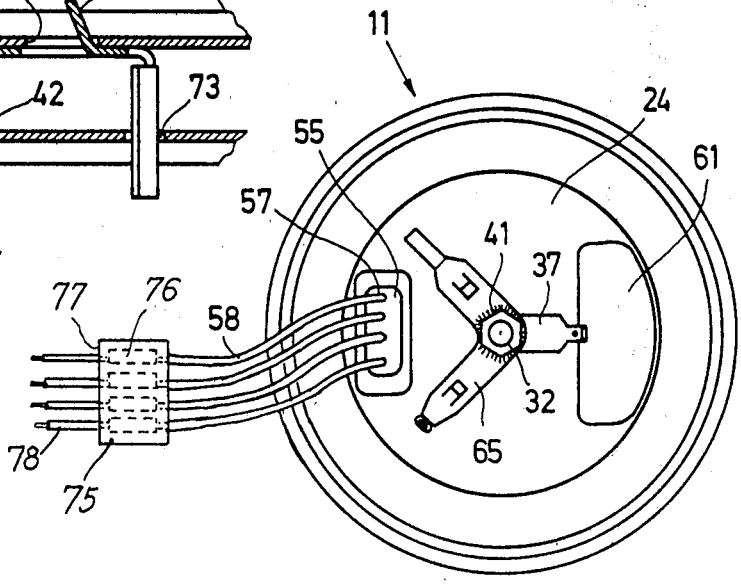
FIG. 15 shows a rear view of this hotplate.

FIG. 12 shows, by means of dash-dot lines, that the anti-rotation sheet metal part 65 may be provided with a third portion 37'' on whose end there is provided a flat insertion tongue 53 for the connection of an earth lead. In this way, one component can be used for a double function, namely preventing rotation and providing the earth connection. However, as shown in FIG. 15, it is also possible for the sheet metal part 37' in addition to the anti-rotation part 65 to be screwed on by means of the screw 32. Since the part 65 is in any case prevented from rotating, a grooved portion 41 on the latter is sufficient and none is needed on the covering sheet.

Since the hotplates are preferably packed in a position offset by 180°, the depression 61 is diametrically opposite the insulating member 55. Of course, it would also be possible to offset the hotplates by a different angle. The depression 61 would then also have to be offset by a different angle relative to the insulating member 55. In any case, the advantage of the covering sheet is that it is easy to produce owing to its not very great deformation, in spite of being sufficiently rigid, and it provides a sealed inner space which gives good insulation. In an embodiment having a central perforation for a central sensor cell, the cover could abut both on the outer border 21 and also on the inner edge surrounding the sensor recess, with a step, to follow the covering sheet. Here, again, hollow screws could be used for securing. In this case, therefore, the pin with the internal thread would, for example, not be located centrally but would be in the region of the outer border.

We claim:

1. An electrical hotplate for use in a cooking applicance having:

a hotplate member with a downwardly projecting pin with an internal thread, electrical heating resistor means secured to the underside of said hotplate member, a covering sheet covering the underside of the hotplate member, screw means to secure both the covering sheet to the hotplate and the hotplate to the cooking appliance, the screw means comprising:

a hollow screw having an internal and an external thread and an outwardly projecting shoulder, the external thread being screwed into said pin and securing the covering sheet between the shoulder and the pin and a fastening screw for mounting the cooking hotplate at the cooking appliance, which fastening screw can be screwed into the internal thread.

2. An electric hotplate according to claim 1, wherein the screw means consists of a sheet metal sleeve, the shoulder being flanged thereto and the sleeve being provided with a pressed thread.

3. An electric hotplate according to claim 1, wherein the shoulder has a grooved portion to engage a correspondingly shaped portion on the covering sheet.

4. An electric hotplate according to claim 1, wherein the shoulder has a grooved portion to engage a correspondingly shaped portion on a member interposed between the covering sheet and the shoulder.

5. An electric hotplate according to claim 1, wherein an interposed member consisting of sheet metal is clamped between the shoulder of the screw and the covering sheet and has at least one projection projecting outwards from the central region of the hotplate.

6. An electric hotplate according to claim 5, wherein the projection has a terminal for an electrical earth connection.

7. An electric hotplate according to claim 4, wherein the interposed member comprises a projection shaped to be bent away from the covering sheet in order to engage fixing means on the cooking appliance to prevent the electric hotplate from rotating.

8. An electric hotplate according to claim 6, wherein the interposed member is clamped nonrotatably to the electric hotplate by means of tabs bent out of the plane of the interposed member and penetrating in recesses of the covering sheet.

9. An electric hotplate according to claim 1, wherein the hollow screw and the fastening screw comprise screw heads provided with key faces.

* * * * *

UNITED STATES PATENT AND TRADEMARK OFFICE

CERTIFICATE OF CORRECTION

PATENT NO. : 4,414,466

DATED : November 8, 1983

INVENTOR(S) : Karl Fischer and Felix Schreder

It is certified that error appears in the above-identified patent and that said Letters Patent are hereby corrected as shown below:

Column 3, line 19 delete "and" (second occurrence).

Column 3, line 20 delete "provedes" and insert --provides--.

Column 5, line 38 delete "bee" and insert --been--.

Column 7, lines 45-46 delete "applicance" and insert --appliance--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*